US008952285B2

(12) United States Patent
Cimala et al.

(10) Patent No.: US 8,952,285 B2
(45) Date of Patent: Feb. 10, 2015

(54) MEDIUM AND HIGH-VOLTAGE ELECTRIC SWITCH WITH RETURN ON CLOSURE AND AN INSERTION DEVICE FOR INSERTING A RESISTANCE

(75) Inventors: André Cimala, Villeurbanne (FR); Gwenaël Marquezin, Villeurbanne (FR)

(73) Assignee: Alstom Technology Ltd. (CH)

( * ) Notice: Subject to any disclaimer, the term of this patent is extended or adjusted under 35 U.S.C. 154(b) by 332 days.

(21) Appl. No.: 13/583,453

(22) PCT Filed: Mar. 8, 2011

(86) PCT No.: PCT/EP2011/053466

§ 371 (c)(1), (2), (4) Date: Jan. 11, 2013

(87) PCT Pub. No.: WO2011/110557

PCT Pub. Date: Sep. 15, 2011

(65) Prior Publication Data

US 2013/0119022 A1 May 16, 2013

(30) Foreign Application Priority Data

Mar. 9, 2010 (FR) ..... 10 51680

(51) Int. Cl.

| | |
|---|---|
| ***H01H 33/88*** | (2006.01) |
| ***H01H 33/02*** | (2006.01) |
| ***H01H 33/12*** | (2006.01) |
| ***H01H 33/16*** | (2006.01) |
| ***H01H 33/70*** | (2006.01) |

(52) U.S. Cl.

CPC ..... *H01H 33/02* (2013.01); *H01H 33/12* (2013.01); *H01H 33/167* (2013.01); *H01H 33/70* (2013.01)

USPC ..... 218/57; 218/84; 218/154

(58) Field of Classification Search

USPC ..... 218/57–64, 89, 154

See application file for complete search history.

(56) References Cited

U.S. PATENT DOCUMENTS

| | | | | |
|---|---|---|---|---|
| 3,745,283 | A | 7/1973 | Bischofberger et al. | |
| 3,914,569 | A * | 10/1975 | McConnell et al. | 218/64 |
| 4,211,904 | A * | 7/1980 | Karrenbauer | 218/59 |
| 4,338,500 | A | 7/1982 | Pham Van et al. | |
| 4,491,707 | A * | 1/1985 | O'Leary | 218/89 |
| 4,556,767 | A * | 12/1985 | Egli et al. | 218/59 |

(Continued)

FOREIGN PATENT DOCUMENTS

| | | |
|---|---|---|
| DE | 3312797 | 12/1983 |
| EP | 0508160 | 10/1992 |
| FR | 2450501 | 3/1979 |

*Primary Examiner* — Truc Nguyen

(74) *Attorney, Agent, or Firm* — Baker Hostetler LLP

(57) ABSTRACT

An electric switch for application to high- and very high-voltage circuit breakers and switches comprising a flexible toroidal helical spring (8) placed in a groove of a control rod (1) carrying a movable resistance-insertion contact (2), and springs (4) placed about the movable resistance-insertion contact to cause the springs to be compressed until a certain value is reached, at which value the movable resistance-insertion contact causes the flexible toroidal helical spring (8) to deform under pressure enabling the movable resistance-insertion contact (2) to be withdrawn. Among other uses, the switch is suitable for use in a resistance-inserting device that does not need additional mechanical moving parts.

For application to high- and very high-voltage circuit breakers and switches.

4 Claims, 2 Drawing Sheets

(56) References Cited

U.S. PATENT DOCUMENTS 5,248,862 A 9/1993 Blatter
6,787,725 B2 * 9/2004 Kim et al. ..... 218/57
2012/0273464 A1 * 11/2012 Yeon ..... 218/154
2013/0248492 A1 * 9/2013 Froebel et al. ..... 218/18

* cited by examiner

MEDIUM AND HIGH-VOLTAGE ELECTRIC SWITCH WITH RETURN ON CLOSURE AND AN INSERTION DEVICE FOR INSERTING A RESISTANCE

FIELD OF THE INVENTION

The invention relates to the field of high- and very high-voltage electrical switchgear, in particular switches and/or circuit breakers that insert one or more resistances during current closing operations.

PRIOR ART AND PROBLEM POSED

In switchgear for switching and breaking high- and very high-voltage currents, it is known to use one or more resistances, connected in parallel with the reverse-flow chamber of the assembly, in order to limit the surge phenomena when re-closing overhead. Thus, the various mechanisms provide for the insertion of said resistance or resistances just before closing the main contacts that are needed to pass the main current.

Numerous devices have been designed. However, they lead to some drawbacks that include, among others, manufacturing costs that are too high due to a large amount of milling and the use of an unlocking system having a dead center.

However, with reference to FIG. 1, a resistance-insertion device is known, from French patent application no. 2 450 501 for inserting a resistance during the closing operation of current-breaking switchgear comprising an arc-control chamber, a main movable contact 15, the resistance-insertion contacts 12 and 13 being placed in the arc-control chamber of the switchgear to be movable along a trajectory that is parallel to that of the main movable contact 15. In that device, the closure resistance is in alignment with the arc-control chamber and is placed inside it, not being shown in the drawings, one at the contacts for ensuring the insertion of the closure resistance is fastened to one of the main breaking contacts and is mounted to slide relative to one of the main breaking contacts. Temporary resilient connection means are used between the moveable resistance contact and its support element so that the movable resistance contact is able to take up two defined positions. Those temporary resilient connection means are made up of a plurality of balls 19, placed in holes and each ball is thrust by a spring 18 towards the inside wall of the movable resistance contact 12, which includes two series of notches 20 and 21 corresponding to the two positions of the temporary resilient connection means.

Mechanically, that system is relatively complicated.

There also exist toroidal and flexible helical springs that are used as temporary mechanical connection means. Patent document WO 2004/031595 A2 describes such a spring.

SUMMARY OF THE INVENTION

The object of the invention is to overcome the drawbacks of the above-mentioned systems. To this end, a first subject matter of the invention is a medium- or high-voltage electric switch that is provided with a mechanical device comprising:

- a control rod; and
- a movable resistance-insertion contact that is able to be secured temporarily to the control rod.

According to the invention, this electric switch has a flexible toroidal helical spring placed in a groove of the control rod and an energy accumulation system pressing against the movable resistance-insertion contact, which system is intended to be loaded until it reaches a certain value at which the flexible toroidal helical spring deforms under the force and enables the movable contact to be withdrawn.

A second subject matter of the invention is a resistance-insertion device for use in an electric switch during a closing operation of the switch, insertion of the resistance needing to take place parallel to the movement of the arc-control chamber of the switch, the insertion device comprising:

- two resistance-insertion contacts: one movable and one stationary;
- the control rod (movement input link) directly connected to the arc-control device and temporarily secured to the movable resistance-insertion contact;
- a contact carrier for carrying the movable resistance-insertion contact and suitable for conveying the current flowing in the resistance;
- at least one return spring constituting the energy accumulation system that enables the movable resistance-insertion contact to return to its initial position and that is placed between the contact carrier, which is tubular, and the movable resistance-insertion contact, which is also tubular and secured to the control rod, the at least one return spring being suitable for use as a conductor associated with the resistance;
- a guide strip between the movable insertion contact and its contact carrier; and
- a resilient element for temporarily connecting the movable resistance-insertion contact to the control rod so as to secure these two parts together temporarily.

In the invention, the resilient connection element for connecting the movable resistance-insertion contact and the control rod is constituted by the spring of the flexible, toroidal, and helical type that is placed inside a notch of the control rod (or of the movable resistance-insertion contact) and a groove of the control rod (or of the movable contact), and the device includes one or more return springs.

Preferably, the device includes an intermediate contact for enabling the insertion current to pass between the end of the movable resistance-insertion contact and the contact carrier.

In a preferred embodiment, at least a portion of the resistance that is to be inserted is placed about the control rod.

LIST OF FIGURES

The invention and its various characteristics can be better understood from the following description of an embodiment of the invention. The description is accompanied by four figures in which, respectively:

FIG. 1, described above, shows a resistance-inserting device of the prior art;

DETAILED DESCRIPTION OF AN EMBODIMENT OF THE INVENTION

The first use intended for the switch of the invention is for a resistance-insertion device of the invention that is usable in parallel with the arc-control chamber of the switch on which the assembly is installed. It is recalled that the purpose is to insert resistances during a length of time that lies in the range four milliseconds to 15 milliseconds in order to dissipate a portion of the energy that is likely to give rise to surges during closing operations on electric lines.

The resistance-insertion device of the invention makes it possible for the resistance-insertion contact to return to its open position before the main contacts of the switch or circuit breaker have the time to close and re-open during a closing/opening operation. This is to avoid obstructing the switch or the circuit breaker during the opening operation, in particular in such a manner as to withstand the recovery voltage during breaking. For this reason, the contacts of the resistance-insertion device need to be at a distance that is that is sufficient in order to enable the recovery voltage to be obtained, in a manner that is certain, during the opening of the main contacts of the switch or circuit breaker in which the device of the invention is installed.

Figure 2:
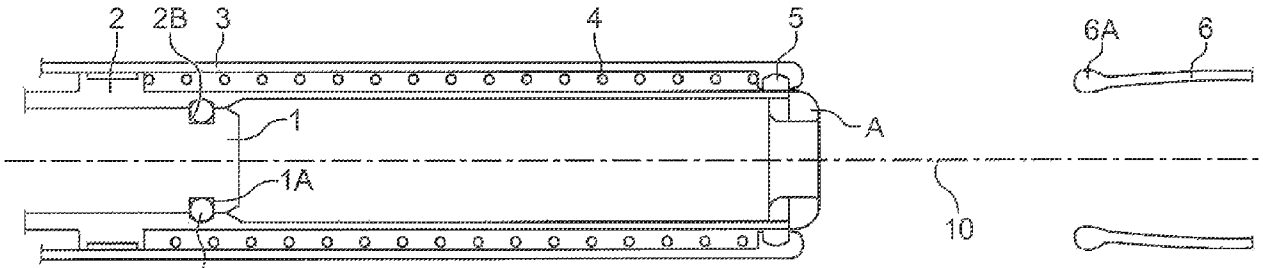
FIG. 2 shows a switch of the invention with a resistance-inserting device of the invention in a first position before the closure of the electrical switch in a first position.

With reference to FIG. 2, the insertion device of the invention has a control rod 1, or movement input link that is directly linked to the stroke of the main arc-control chamber of the switch or circuit breaker, it being possible for the strokes of said device and switch or circuit breaker to be different. The control rod 1 is secured temporarily to a movable resistance-insertion contact 2 having an end 2A that is provided for making contact, with the end 6A of a stationary resistance-insertion contact 6. In the embodiment described, all of these elements are axisymmetric about a single axis 10, which is preferably parallel to the axis of the direction of movement of the main contacts of the switch or circuit breaker to which the insertion device of the invention applies.

In this embodiment, a contact carrier 3 makes it possible to hold the assembly and to convey the current, where necessary, e.g. if the control rod 1 is made of an insulating material and the resistance itself, which is not shown in this figure, is placed about the rod. In this event, an intermediate contact 5 is used that is placed between the end of a contact carrier 3 and the movable resistance-insertion contact 2. Finally and above all, the contact carrier 3 serves to guide the movable resistance-insertion contact 2. As such, the movable resistance-insertion contact 2 includes a shoulder 9 carrying a guide strip 7 for guiding its movements in the contact carrier 3. The contact carrier 3 is secured to the movable resistance-insertion contact 2 and to the control rod 1.

One or more return springs 4 are placed in the cylindrical space arranged between the inside face of the contact carrier 3 and the outside face of the movable resistance-insertion contact 2. The return springs 4 can be used as conductors in relation to the resistance to be inserted.

Figure 3:
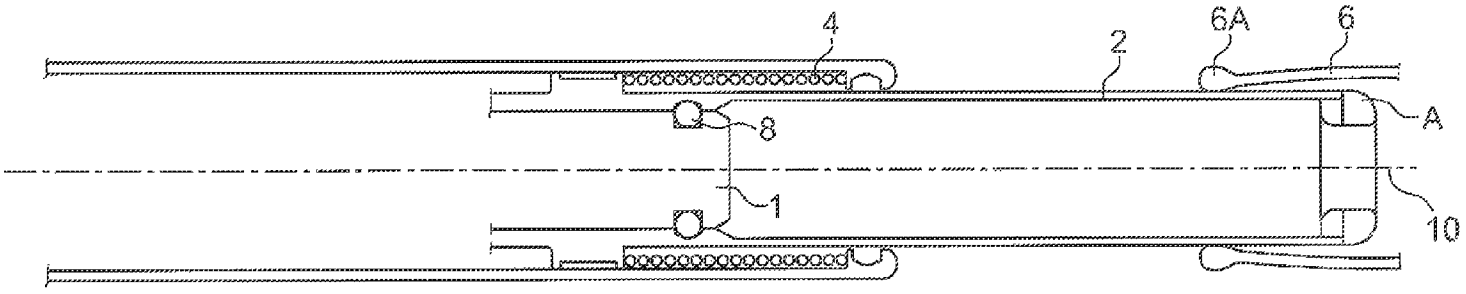
FIG. 3 is a cross-section showing the same switch of the invention in a closed, second position of the switch.

With reference to FIG. 3, the movable resistance-insertion contact 2 and the control rod 1 are moved in translation towards the right until the end 2A of the movable insertion contact 2 penetrates into the inside of the end 6A and of the stationary resistance-insertion contact in order to establish electrical contact between them and cause the resistance to be operational. As a result, the springs 4 are compressed.

The means for establishing a temporary connection between the control rod 1 and the movable resistance-insertion contact 2 are constituted by a groove 1A, made in the outer surface of the control rod 1, by a toroidal helical spring 8 that is flexible and by a notch 2B, made in the inside surface of the movable resistance-insertion contact 2.

Once the compression of the return spring 4 has reached a certain value, said compression offers resistance such that it acts via a shoulder 9, to push the movable resistance-insertion contact 2 towards its initial position, the flexible toroidal helical spring 8 being deformed under the pressure of the force. As a result, the spring moves out of the notch 2B of the movable resistance-insertion contact 2 and enables said movable resistance-insertion contact 2 to move back into its initial position.

Figure 4:
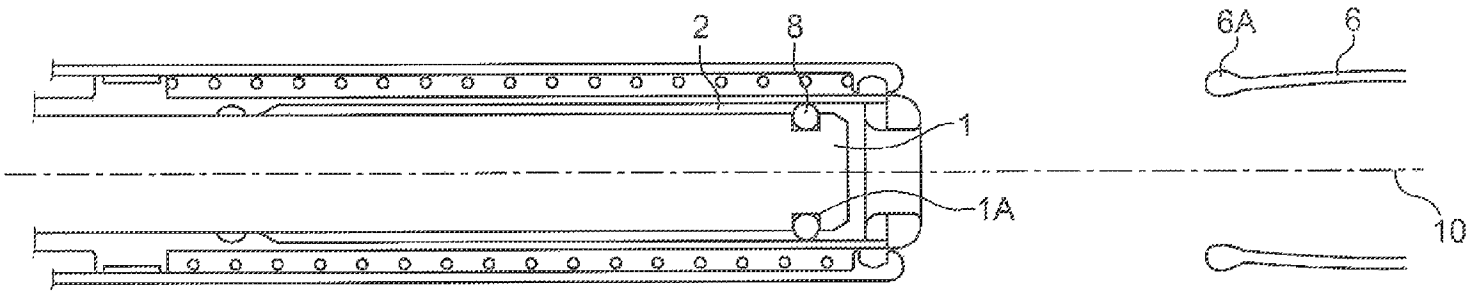
FIG. 4 is a cross-section showing the same switch in a closed, third position of the switch.

FIG. 4 shows this moved back position of the movable resistance contact 2. However, the control rod has continued to move a little in translation along the axis 10, keeping the flexible helical spring 8 in its notch 1A.

Figure 1:
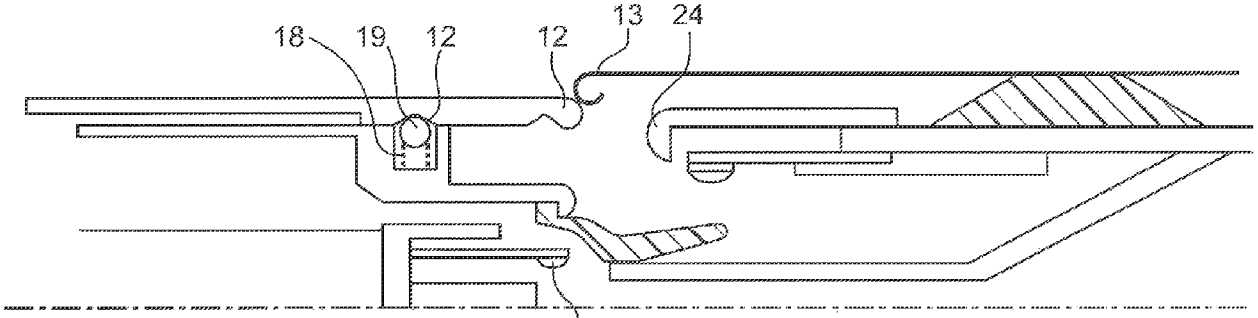

When the switch or circuit breaker is opening, the arc-control chamber drives the control rod 1 in the opposite direction, i.e. the rod returns to the position of FIG. 1, the flexible helical spring 8 returning to the notch 2B of the movable resistance-insertion contact 2.

By means of the impacts from the electric contacts, namely the ends 2A and 6A of the movable resistance-insertion contact 2 and of the stationary resistance-insertion contact 6, it is also possible to cause the movable insertion contact 2 to be released from the control rod 1. In this event, the inertia of the movable resistance-insertion contact 2 causes the contact to penetrate into the stationary resistance-insertion contact 6 and to move in the opposite direction, under the effect of the return springs 4.

Another impact may be caused deliberately in some other way.

A second type of spring can be added to the return spring 4, but having a different spring rate in order to give rise to a sharp increase in end-of-stroke forces.

It is found that this system is relatively simple, while enabling the movable resistance-insertion contact to be moved back and forth.

The system avoids using retractable movable portions, both for tire stationary resistance-insertion contact and for the movable resistance-insertion contact.

The flexible toroidal helical spring 8 used in the switch of the invention is a known spring. This type of spring is of the type sold, among others, by Bal Seal Engineering.

The invention claimed is:

1. A medium or high-voltage electric switch provided with a mechanical device comprising:

a control rod; and a movable resistance-insertion contact that is able to be secured temporarily to the control rod;

the switch being characterized in that it has a flexible toroidal helical spring placed in a groove of the control rod and an energy accumulation system pressing against the movable resistance-insertion contact;

wherein the energy accumulation system is intended to be loaded until it reaches a certain value at which the flexible toroidal helical spring deforms under a force and enables the movable resistance-insertion contact to be withdrawn to move back into its initial position.

2. A resistance-insertion device comprising:

a tubular movable resistance-insertion contact and a stationary resistance-insertion contact;

a control rod directly connected to an arc-control device and temporarily secured to the movable resistance-insertion contact;

a tubular contact carrier for carrying the movable resistance-insertion contact and suitable for conveying the current flowing in the resistance;

at least one return spring constituting an energy accumulation system that enables the movable resistance-insertion contact to return to its initial position and that is placed between the tubular contact carrier and the movable resistance-insertion contact and secured to the control rod;

wherein the at least one return spring being suitable for use as a conductor associated with the resistance;

a guide strip between the movable resistance-insertion contact and the tubular contact carrier; and a resilient element for temporarily connecting the movable resistance-insertion contact to the control rod so as to secure these two parts together temporarily;

characterized in that the resilient element is constituted by a flexible toroidal helical spring placed inside a notch of the control rod or of the movable resistance-insertion contact and a groove of the control rod or of the movable resistance-insertion contact.

3. A device according the claim 2, characterized in that it includes an intermediate contact for enabling an insertion current to pass between an end of the movable resistance-insertion contact and the contact carrier.

4. A device according to claim 2, characterized in that a portion or all of the movable resistance-insertion contact that is to be inserted is placed about the control rod.

* * * * *